US006263540B1

(12) United States Patent
Vanderlinden

(10) Patent No.: US 6,263,540 B1
(45) Date of Patent: Jul. 24, 2001

(54) COMPACT UTILITY TYPE SURFACE CLEANING VEHICLE

(76) Inventor: Roger P. Vanderlinden, 73 Sherman Ave. S., Hamilton (CA), L8M 2P8

( * ) Notice: Subject to any disclaimer, the term of this patent is extended or adjusted under 35 U.S.C. 154(b) by 0 days.

(21) Appl. No.: 09/370,877

(22) Filed: Aug. 10, 1999

(51) Int. Cl.[7] ..... E01H 1/08
(52) U.S. Cl. ..... 15/346; 15/340.2; 15/340.3
(58) Field of Search ..... 15/346, 347, 348, 15/340.2, 340.3

(56) References Cited

U.S. PATENT DOCUMENTS 514,676 * 2/1894 Furnas ..... 15/347
1,615,348 * 1/1927 Schroeder ..... 15/348 X
3,184,777 * 5/1965 Norden ..... 15/340.3 X
3,203,022 * 8/1965 Clarke ..... 15/347 X
3,490,090 * 1/1970 Harrison ..... 15/340.3 X
3,903,565 * 9/1975 Hicks ..... 15/347 X
4,044,422 * 8/1977 Larsen ..... 15/348 X
5,107,661 * 4/1992 Shimamura ..... 15/347 X
5,317,783 * 6/1994 Williamson ..... 15/347 X
6,029,312 * 2/2000 Whitney ..... 15/347
6,070,290 * 6/2000 Schwarze et al. ..... 15/340.4 X

* cited by examiner

*Primary Examiner*—Chris K. Moore

(57) ABSTRACT

A utility type surface cleaning vehicle comprises a unitary frame utility type tractor defining a longitudinal axis and having a front end and a back end, left and right driven rear wheels and at least one steerable front wheel and a trailer connecting mechanism. A debris hopper is removably connectable to the utility type tractor via the trailer connecting means. A main surface cleaning apparatus is operatively mountable on the unitary frame utility type tractor between the front end and the back end thereof, and is connected in debris depositing relation via a debris transfer mechanism to the debris hopper.

7 Claims, 3 Drawing Sheets

COMPACT UTILITY TYPE SURFACE CLEANING VEHICLE

FIELD OF THE INVENTION

The present invention relates to surface cleaning vehicles and more particularly to utility type surface cleaning vehicles.

BACKGROUND OF THE INVENTION

The removal of dirt and debris from streets, parking lots, airport runways, factory floors, and other similar paved surfaces, through the use of various types of street cleaning vehicles or factory sweeping vehicles, as may be the case, has been known for many years. For the sake of brevity, clarity and simplicity, such vehicles will be generally referred to in this document as surface cleaning vehicles.

Conventional surface cleaning vehicles comprise a surface cleaning mechanism, such as a sweeping broom, a recirculating air type air head, or a vacuum air head. Most commonly, such surface cleaning mechanisms are permanently mounted on a truck frame. Alternatively, such surface cleaning mechanisms are removably connected to a tractor, either securely attached to the three point hitch for direct turning with the tractor, or connected in freely pivoting relation to the towbar. The tractors being referred to are typically conventional unitary frame—or in other words are non-articulated—utility type tractors, manufactured by companies such as Ford, John Deere, Massey Ferguson, among others. Such conventional tractors are powered by an internal combustion engine that typically can produce about sixty-five to seventy horsepower.

Utility type surface cleaning vehicles have inherent cost and overall operational advantages over truck type surface cleaning vehicles in that the tractors can additionally be used to perform other tasks, such as ploughing snow, cutting grass, and so on. However, in spite of these advantages that are extremely important to the owners or operators of such vehicles, utility type surface cleaning vehicles are much less popular than truck type surface cleaning vehicles largely due to their overall performance, And also due to their slow maximum speed while travelling between work sites.

A serious drawback with utility type surface cleaning vehicles is that the main surface cleaning apparatus—excluding the gutter brooms, the debris hopper, and the debris transfer apparatus are all positioned behind the tractor, and the gutter brooms are positioned in front of the tractor. Accordingly, the overall vehicle is quite long, which means that is difficult for such utility type surface cleaning vehicles to safely and properly manoeuver around objects on a city street, to accurately turn corners in a city block while maintaining one gutter broom properly against a curb, and so on. Further, it is extremely difficult, to turn around such a utility type surface cleaning vehicle in a dead-end street, which is unacceptable.

In some utility type surface cleaning vehicles, both the gutter brooms and the hopper are located behind the tractor portion. Accordingly, the overall vehicle is extremely long, thus making it even more difficult to manoeuver Further, during the operation of the surface cleaning vehicle, it is necessary for the operator to look in a rearward direction in order to watch the main surface cleaning apparatus and to properly follow the curb. This is potentially dangerous since it is necessary for the operator to look in a forward direction in order to watch the road in general and to view the gutter brooms, to ensure that the gutter brooms are disposed in contacting relation with the curb. Accordingly, in a utility type surface cleaning vehicle, it is very undesirable to have the main surface cleaning apparatus disposed behind the tractor.

It is therefore very important that utility type surface cleaning vehicles are as short as reasonably possible.

It is an object of the present invention to provide a utility type surface cleaning vehicle that is less lengthy than prior art utility type surface cleaning vehicles.

It is an object of the present invention to provide a utility type surface cleaning vehicle that is easier to manoeuver than prior art utility type surface cleaning vehicles.

It is another object of the present invention to provide a utility type surface cleaning vehicle wherein the main surface cleaning apparatus is not disposed behind the tractor.

SUMMARY OF THE INVENTION

In accordance with one aspect of the present invention, there is disclosed a novel utility type surface cleaning vehicle comprising a unitary frame utility type tractor defining a longitudinal axis and having a front end and a back end, left and right driven rear wheels and at least one steerable front wheel and trailing unit connecting means. A debris hopper is removably connectable to the utility type tractor via said trailer connecting means. Further, it is envisioned that the trailing unit 50 could be removably connectable to the unitary frame utility type tractor 30 by other suitable means such as bolting the trailing unit 50 directly to the frame of the unitary frame utility type tractor 30, including welding the bolts in place for additional strength. Such welding could be easily broken for removal of the trailing unit 50. Also, it is envisioned that the trailing unit 50 could be removably connectable to the unitary frame utility type tractor 30 either to three point hitch 46, the towbar 48, or directly to the frame of the unitary frame utility type tractor 30 by welding alone, if desired. A main surface cleaning apparatus is operatively mountable on the unitary frame utility type tractor between the front end and the back end thereof, and is connected in debris depositing relation via a debris transfer means to the debris hopper.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the surface cleaning vehicle, according to the present invention, as to its structure, organization, use and method of operation, together with further objectives and advantages thereof, will be better understood from the following drawings in which a presently preferred embodiment and an alternative embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
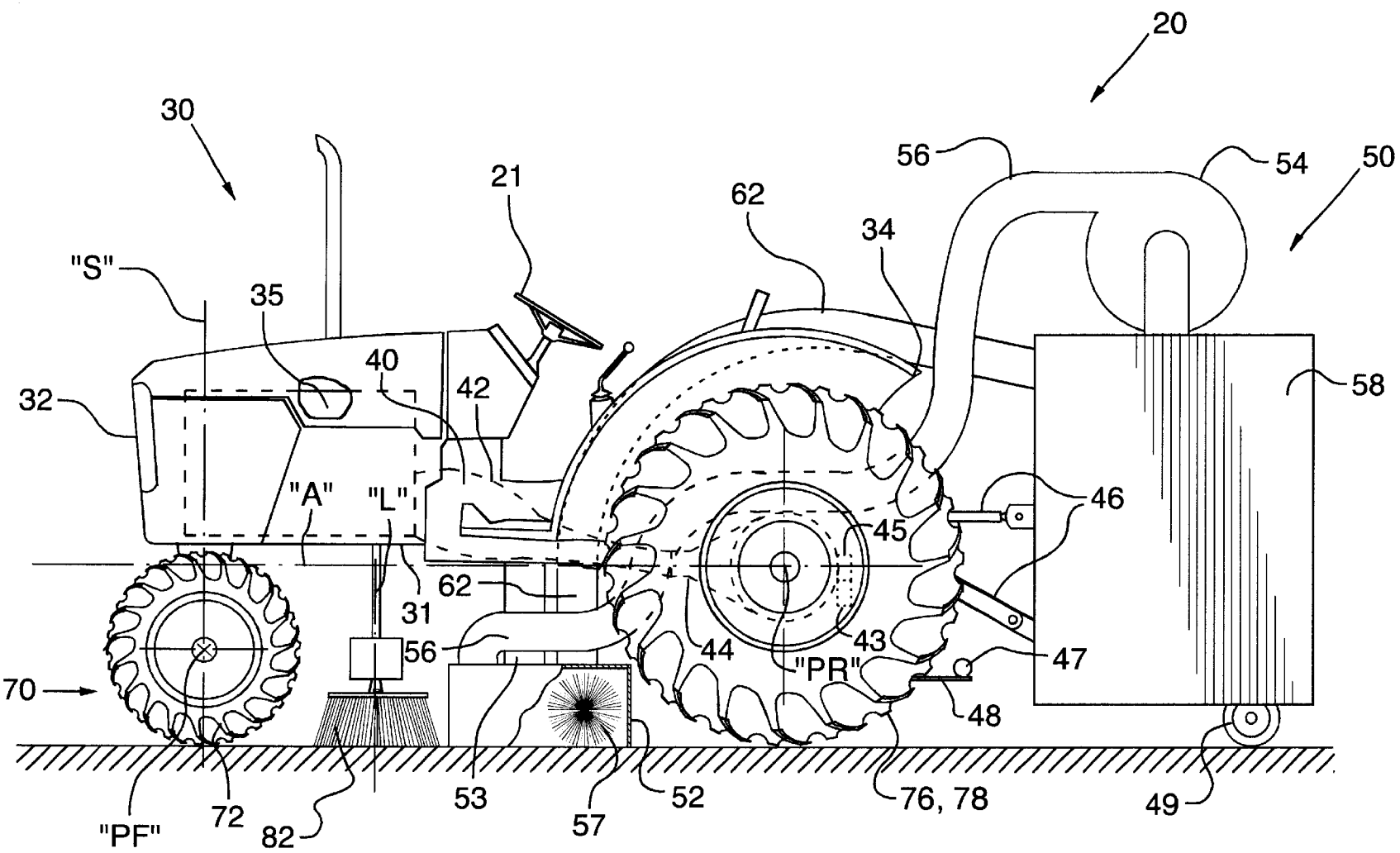
FIG. 1 is a side elevational view of a preferred embodiment utility type surface cleaning vehicle according to the present invention.
Figure 2:
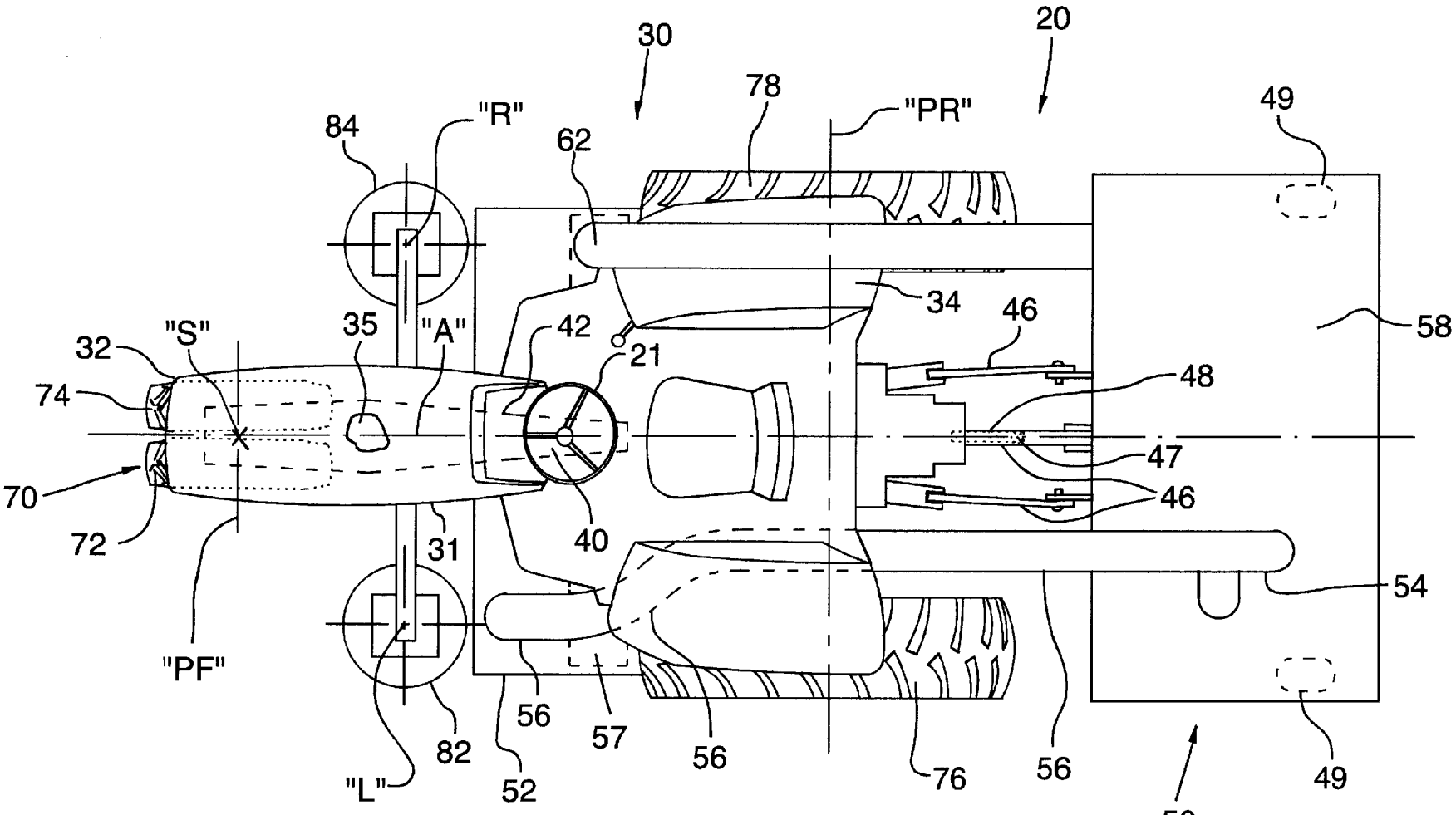
FIG. 2 is a top plan view of the preferred embodiment utility type surface cleaning vehicle of FIG. 1; and, FIG. 3 is a top plan view of an alternative embodiment utility type surface cleaning vehicle according to the present invention.
Figure 3:
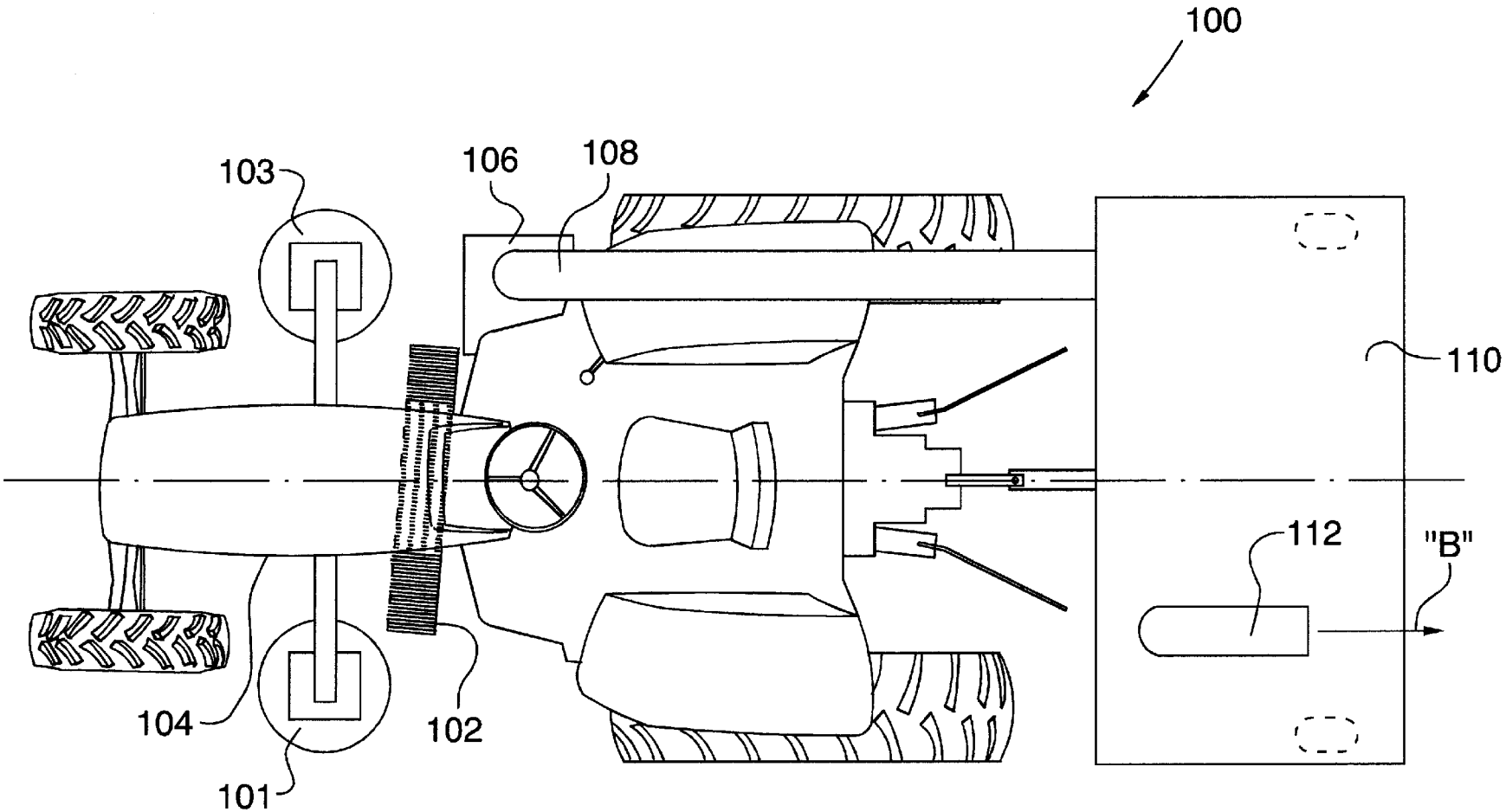

Reference will now be made to FIGS. 1 through 3 of the drawings, which show a preferred embodiment and an alternative embodiment of the utility type surface cleaning vehicle according to the present invention.

Reference will first be made to FIGS. 1 and 2, which show a preferred embodiment utility type surface cleaning vehicle, as indicated by the general reference numeral 20. The utility type surface cleaning vehicle 20 includes a unitary frame—or in other words non-articulating—utility type tractor, as indicated by the general reference numeral 30, having a front end 32 and a back end 34, and a frame 31 which defines a longitudinal axis "A". An internal combustion engine 35 that produces about sixty-five to seventy horsepower is mounted within an external engine housing 36 forming part of the unitary frame utility type tractor 30. A manual transmission 40 is connected in driven relation to the internal combustion engine 35, with the robust housing 42 of the manual transmission 40 forming part of the unitary frame utility type tractor 30. A rear differential 44 is connected in driven relation to the manual transmission 40 and also forms part of the unitary frame utility type tractor 30. Alternatively, the unitary frame utility type tractor 30 could be hydraulically driven. A power take-off mechanism 45 is operatively mounted on the utility type tractor 30. More specifically, the power take-off mechanism 45 is connected in driven relation to the internal combustion engine 35. A Trailer connecting means comprising a three-point hitch 46 and/or a towbar 48 are mounted on the frame 32 of the tractor 30.

There is at least one steerable front wheel, as indicated by the general reference numeral 70, and in the preferred embodiment as illustrated, there is a left front wheel 72 and a right 74 front wheel 74. The left 72 and right 74 front wheels are mounted on the frame 31 for free rotation about a substantially horizontal front wheel pivot axis "PF", and are steerable by means of the tractor's steering wheel 21 such that the front wheel pivot axis moves angularly with respect to a substantially vertical steering axis "S" between an extreme left angular orientation and an extreme right angular orientation. Analogously, the tractor may have a standard fixed front axle with left and right wheels mounted at the opposite ends thereof for co-operating turning about spaced apart axes.

Left 76 and right 78 driven rear wheels are mounted on the frame 31 at the rear differential 44 for selectively driven rotation about a substantially horizontal rear wheel pivot axis "PR", as powered by the internal combustion engine 35.

Such tractors 30 are typically used in agricultural applications and on construction sites, for low speed carrying, pushing, or pulling of implements. For the purpose of this document, the terms "tractor" and "tractors" do not include truck-type tractors used to pull transport trailers and do not include trucks.

Left 82 and right 84 gutter brooms are each mounted on the surface cleaning vehicle 20 for rotation about substantially vertical left and right gutter broom axes "L" and "R", respectively. Preferably, the left 82 and right 84 gutter brooms are disc-type brushes and are selectively moveable between a lowered surface cleaning position, as can be seen in FIG. 1, and a raised position, which is not specifically illustrated. The left 82 and right 84 gutter brooms are mounted such that the left "L" and right "R" gutter broom axes are disposed entirely rearwardly of the foremost portion of the left 72 and right 74 steerable front wheels, when the front wheels 72, 74 are straight. Further, the left 82 and right 84 gutter brooms are mounted forwardly of the left 76 and right 78 driven rear wheels so as to not interfere with the driven rear wheels 76, 78.

In the preferred embodiment, as illustrated, the left 82 and right 84 gutter brooms are each mounted on the surface cleaning vehicle 20 so as to be disposed entirely rearwardly of the left 72 and right 74 steerable front wheels, and disposed immediately forwardly of the driven rear wheels 76, 78.

A main surface cleaning apparatus that, in the preferred embodiment as illustrated, comprises a recirculating air type pick-up head 52, is operatively mountable via mounting brackets 53 (only one viewable) in removable relation on the unitary frame utility type tractor 30 so as to be disposed there-beneath between the front end 32 and the back end 34 of the tractor 30. Preferably, the pick-up head 52 is mounted between the front wheels 72, 74 and the driven rear wheels 76, 78, so as to extend laterally outwardly from each of the left and right sides of the frame 31.

The recirculating air type pick-up head 52 receives a stream of air from a main fan 54 through a removably mountable air supply hose 56. The recirculating air type pick-up head 52 includes a cylindrically shaped rotating sweeping broom 57 powered hydraulically by means of a pump 43 mounted on the power take-off mechanism 45 through hydraulic hoses (not shown).

A trailing unit, as indicated by the general reference numeral 50, is removably mountable to the surface cleaning vehicle via the three point hitch 46. In this case, the weight of the trailing unit 50 is borne partly, or even mostly, by the frame 31, and partially by wheels 49. Also, the trailing unit 50 would turn with the tractor 30, with the back end of the trailing unit 50 extending outwardly in the opposite direction to the direction of turn of the tractor 30. Alternatively, the towbar 48 could be used, but with any unit towed via the towbar 48, the weight of the trailing unit 50 is borne mostly by wheel means mounted on the trailing unit 50, and accordingly, the trailing unit 50 would be towed in freely pivotal relation about the hitch portion 47 of the towbar 48.

In either case, the trailing unit 50 includes a debris hopper 58 that is thereby removably connectable to the unitary frame utility type tractor 30 so as to be disposed rearwardly of the frame 31, with the main fan 54 mounted thereon.

The trailing unit 50 also includes a debris transfer means comprising a suction hose 62 mounted in removable relation on the unitary frame utility type tractor 30. The suction hose 62 is in fluid communication with the recirculating air type pick-up head 52 and the debris hopper 58. The recirculating air type pick-up head 52 is thereby connected in debris depositing relation, via the suction hose 62, to the debris hopper 58. The debris hopper 58 thereby receives debris from the recirculating air type pick-up head 52.

In an alternative embodiment of the utility type surface cleaning vehicle according to the present invention, as indicated by the general reference numeral 100 in FIG. 3, the main surface cleaning apparatus comprises a windrow broom 102 disposed in transversely angled relation beneath the frame 104 and a vacuum type pick-up head 106 disposed immediately behind the trailing end of the windrow broom 102 and connected in debris depositing relation, via the suction hose 108, to the debris hopper 110. The left gutter broom 101 moves dirt and debris inwardly towards the center of the tractor 30 so as to be received by the windrow broom 102, and the right gutter broom 103 moves dirt and debris inwardly towards the center of the tractor 30 so as to be received by the windrow broom 102 and by the vacuum type pick-up head 106. The windrow broom 102 feeds a vacuum type pick-up head 106 disposed at the right side of the frame 104. Debris is gathered by the vacuum type pick-up head 106 and is suctioned through the suction hose 108 to the debris hopper 110, as powered by the main fan 112 mounted on the hopper, for expulsion to the ambient atmosphere, as indicated by arrow "B".

Other variations of the above principles will be apparent to those who are knowledgeable in the field of the invention, and such variations are considered to be within the scope of the present invention. Further, other modifications and alterations may be used in the design and manufacture of the apparatus of the present invention without departing from the spirit and scope of the accompanying claims.

I claim:

1. A utility type surface cleaning vehicle comprising:

a unitary frame utility type tractor defining a longitudinal axis and having a front end and a back end, left and right driven rear wheels and at least one steerable front wheel and trailing unit connecting means;

a debris hopper removably connectable to said utility type tractor via said trailing unit connecting means; and, a recirculating air type pick-up head operatively mountable on said unitary frame utility type tractor between said front end and said back end thereof, and connected in debris depositing relation via a debris transfer means to said debris hopper.

2. The utility type surface cleaning vehicle of claim 1, wherein said recirculating air type pick-up head includes a cylindrically shaped rotating sweeping broom.

3. A utility type surface cleaning vehicle comprising:

a unitary frame utility type tractor defining a longitudinal axis and having a front end and a back end, left and right driven rear wheels and at least one steerable front wheel and trailing unit connecting means;

a debris hopper removably connectable to said utility type tractor via said trailing unit connecting means; and, a windrow broom and a vacuum type pick-up head operatively mountable on said unitary frame utility type tractor between said front end and said back end thereof, said vacuum type pick-up head connected in debris depositing relation via a debris transfer means to said debris hopper.

4. A utility type surface cleaning vehicle comprising:

a unitary frame utility type tractor defining a longitudinal axis and having a front end and a back end, left and right driven rear wheels and at least one steerable front wheel and three point hitch;

a debris hopper removably connectable to said utility type tractor via said three point hitch; and, a main surface cleaning apparatus operatively mountable on said unitary frame utility type tractor between said front end and said back end thereof, and connected in debris depositing relation via a debris transfer means to said debris hopper.

5. A utility type surface cleaning vehicle comprising:

a unitary frame utility type tractor defining a longitudinal axis and having a front end and a back end, left and right driven rear wheels and at least one steerable front wheel and trailer connecting means;

a debris hopper removably connectable to said utility type tractor via said trailer connecting means;

a main surface cleaning apparatus operatively mountable on said unitary frame utility type tractor between said front end and said back end thereof, and connected in debris depositing relation via a debris transfer means to said debris hopper; and, at least one gutter broom mounted on said utility type tractor for rotation about a respective substantially vertical gutter broom axis disposed rearwardly of the foremost portion of said at least one steerable front wheel and disposed forwardly of said left and right driven rear wheels.

6. The utility type surface cleaning vehicle of claim 5, wherein each of said at least one gutter broom is disposed entirely rearwardly of said at least one steerable front wheel.

7. A utility type surface cleaning vehicle comprising:

a unitary frame utility type tractor defining a longitudinal axis and having a front end and a back end, left and right driven rear wheels and at least one steerable front wheel and trailing unit connecting means;

a debris hopper removably connectable to said utility type tractor via said trailing unit connecting means; and, at least one gutter broom and a vacuum type pick-up head operatively mountable on said unitary frame utility type tractor between said front end and said back end thereof, said vacuum type pick-up head connected in debris depositing relation via a debris transfer means to said debris hopper.

* * * * *